US009890503B2

(12) United States Patent
Romero

(10) Patent No.: US 9,890,503 B2
(45) Date of Patent: Feb. 13, 2018

(54) HIGH STRENGTH, INTEGRALLY PRE-STRESSED MONOBLOCK CONCRETE CROSSTIE WITH OPTIMAL GEOMETRY FOR USE IN BALLASTED RAILWAYS

(71) Applicant: SUMACANO REAL ESTATE LLC, San Antonio, TX (US)

(72) Inventor: Mauricio Javier Gutierrez Romero, San Pedro Garza Garcia (MX)

(73) Assignee: GUTANNA INNOVATIVE CONCRETE AND TECHNOLOGIES, LLC, Fort Collins, CO (US)

( * ) Notice: Subject to any disclaimer, the term of this patent is extended or adjusted under 35 U.S.C. 154(b) by 0 days.

(21) Appl. No.: 14/494,540

(22) Filed: Sep. 23, 2014

(65) Prior Publication Data

US 2016/0002863 A1 Jan. 7, 2016

(51) Int. Cl.

| | |
|---|---|
| ***E01B 3/28*** | (2006.01) |
| ***E01B 3/32*** | (2006.01) |
| ***E01B 3/34*** | (2006.01) |

(52) U.S. Cl.

CPC ..... *E01B 3/32* (2013.01); *E01B 3/28* (2013.01); *E01B 3/34* (2013.01)

(58) Field of Classification Search

CPC ... E01B 3/34; E01B 3/28; E01B 1/004; E01B 3/32; B28B 23/043; B28B 23/06

USPC ..... 238/83, 84

See application file for complete search history.

(56) References Cited

U.S. PATENT DOCUMENTS

| | | | | | |
|---|---|---|---|---|---|
| 1,074,014 | A | * | 9/1913 | Proctor | 238/76 |
| 3,070,867 | A | * | 1/1963 | Belle | 249/210 |
| 3,608,011 | A | * | 9/1971 | Jones | 264/70 |
| RE27,954 | E | * | 4/1974 | Kelly | E04C 5/122 403/369 |
| 3,985,482 | A | * | 10/1976 | Suzuki | E02D 5/58 249/94 |
| 4,098,460 | A | | 7/1978 | Olivier-Martin | |
| 4,362,421 | A | * | 12/1982 | Kelly | E04C 5/122 249/190 |
| 4,911,582 | A | * | 3/1990 | Peirce, Jr. | E02D 5/76 405/262 |

(Continued)

FOREIGN PATENT DOCUMENTS

| | | | |
|---|---|---|---|
| DE | 806 858 | * | 4/1951 |
| DE | 41 11 088 | * | 10/1991 |

(Continued)

OTHER PUBLICATIONS

English translation of KR 2014070782 , Jun. 2014.*

(Continued)

*Primary Examiner* — Mark T Le

(74) *Attorney, Agent, or Firm* — Jackson Walker LLP; Christopher J. Rourk; Thomas B. Hayes

(57) ABSTRACT

A monoblock concrete crosstie for railway tracks that achieves a high performance in operation includes a steel structure that is formed from ultra-resistant high strength steel plates embedded in a concrete element and having pre-stressed cold rolled wires with ends that form button head knots which are anchored to the steel plates. A faceted geometry allows optimal material usage and in turn increases the crosstie-ballast interlocking and stability with respect to the support surface.

20 Claims, 4 Drawing Sheets

(56) References Cited

U.S. PATENT DOCUMENTS

| | | | | |
|---|---|---|---|---|
| 5,104,039 | A | 4/1992 | Oestmann | |
| 5,135,164 | A * | 8/1992 | Auer et al. | 238/91 |
| 6,565,288 | B1 * | 5/2003 | McCallion | E02D 5/74 405/259.5 |
| 2005/0252985 | A1 | 11/2005 | Braithwaite | |

FOREIGN PATENT DOCUMENTS

| | | | |
|---|---|---|---|
| EP | 0293781 | B1 | 5/1991 |
| EP | 0361227 | B1 | 10/1992 |
| EP | 0625414 | A1 | 11/1994 |
| EP | 0687772 | A1 | 12/1995 |
| JP | 2001-279602 | * | 10/2001 |
| KR | 2014070782 | * | 6/2014 |

OTHER PUBLICATIONS

Canadian Patent Office; Office Action; Canadian Serial No. 2,882,642; dated Jun. 25, 2015.

Canadian Patent Office; Office Action; Canadian Serial No. 2,882,642; dated Oct. 20, 2015.

Canadian Patent Office; Response to Office Action; Canadian Serial No. 2,882,642; dated Nov. 10, 2015.

* cited by examiner

HIGH STRENGTH, INTEGRALLY PRE-STRESSED MONOBLOCK CONCRETE CROSSTIE WITH OPTIMAL GEOMETRY FOR USE IN BALLASTED RAILWAYS

RELATED APPLICATIONS

This application is related to co-pending U.S. patent application Ser. No. 14/627,474, filed Feb. 20, 2015, which is commonly owned and assigned.

TECHNICAL FIELD

The present disclosure relates generally to crossties, and more specifically to a high strength, integrally pre-stressed monoblock concrete crosstie with optimal geometry for use in ballasted railway.

BACKGROUND OF THE INVENTION

Crossties are used to support rails for railways, and have traditionally been made from wood or concrete.

SUMMARY OF THE INVENTION

A monoblock concrete crosstie for railway tracks is disclosed that achieves a high performance in operation, and which includes a steel structure that is formed from high strength steel plates embedded in a concrete element. The crosstie has pre-stressed cold rolled wires with ends that form button head knots, and which are anchored to the steel plates. A faceted geometry provides for optimal material usage, and in turn increases the crosstie-ballast interlocking and stability with respect to the support surface.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE SEVERAL VIEWS OF THE DRAWINGS

Aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views, and in which.

DETAILED DESCRIPTION OF THE INVENTION

Figure 1:
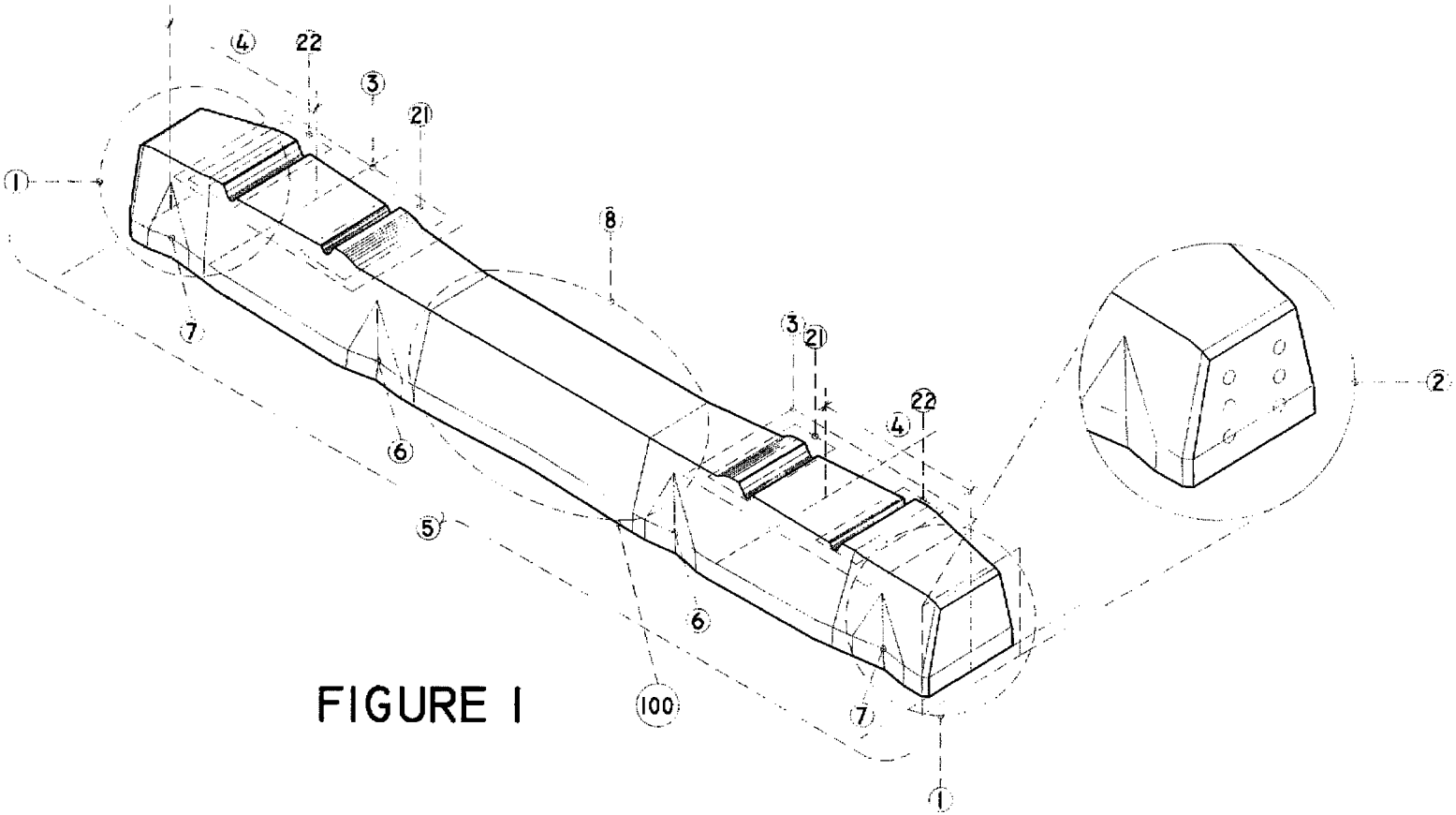
FIG. 1 is an isometric view of a monoblock, high-yield, pre-stressed concrete crosstie with a structural geometry for ballasted railways on which high performance rail fastening systems are installed, in accordance with an exemplary embodiment of the present disclosure.

In the description that follows, like parts are marked throughout the specification and drawings with the same reference numerals. The drawing figures might not be to scale and certain components can be shown in generalized or schematic form and identified by commercial designations in the interest of clarity and conciseness.

Due to the general trend of increasing axle loads of railroad cars, the increase in the operating speed of the trains, and the growth in cumulative gross tonnage, the need to improve existing concrete crossties (also known as ties or sleepers) for railroads has become an important priority for the railroad industry and the economic competitiveness of rail transportation. Increased performance and reduced life cycle costs of concrete ties are necessary for building durable, sustainable railways, as performance and load demands on the track increase.

The present disclosure relates to a pre-stressed concrete monoblock crosstie for ballasted railways that is able to withstand the mechanical stresses caused by the loads transmitted to it by railway traffic. Also, the disclosed crosstie has the ability to withstand the loads that are caused by changes in environmental and support conditions.

The crosstie has an optimized pre-stressed steel structure with a configuration that allows it to resist loads efficiently and sustainably. The steel structure, specifically the steel wires, can be subjected to a tensile force before the casting process. After casting and curing, the wires can be released from the tensioning mold so as to transfer a compression force to the concrete that forms the crosstie. This force produces a compressive stress that is transferred to the concrete monoblock crosstie and has the function of balancing out the tensile stress that the concrete crosstie will otherwise have to bear when a bending load is applied. When pre-stressed steel is used, the adherence of the steel to the concrete increases gradually from the ends of the element to the center to achieve a maximum adherence only after a certain distance, an effect known as transfer length. The crosstie has a steel structure such that maximum adherence along the entire length of the steel wires is achieved within a negligible transfer length. This steel structure interacts with the crossties concrete, which is made of only one piece of concrete that is cast and cured all at once with no construction joints, hence being a monoblock. Together, these features allow the element to function as a beam that is capable of supporting axial, bending and torsion loads, which provides many competitive advantages over other crossties, including disruptive attributes of maximum reliability and performance. The crosstie configuration at its upper surface complies with the international standards for railroad track design and can adapt to the specific needs of various rail fastening systems that may be composed of pieces embedded in the concrete and fixed components on the outside. The side and bottom contours are derived from the design of their applications, optimizing the use of material by increasing the robustness at key locations along the tie and reducing internal stresses. Furthermore the disclosed design ensures that the displacement tolerance of the crosstie in the ballast is not surpassed and avoids the settlement of the element into the substructure, attributes that are advantages compared with other crossties.

The EP 0 625 414 A1 patent discloses a method where a longitudinal mold with an irregular cross-section is introduced inside the crosstie's body that forms a channel through which a steel bar is later inserted and is subsequently post-stressed. When the mold is removed it leaves a rough surface which provides increased adhesion. Once the resulting duct is cleaned with pressurized water and dried, the steel structure is placed inside it and mortar is injected to fill the space between the steel rod and the duct thereby causing the mortar to adhere to the previously casted and cured concrete. The system crosses the wires in an "X" manner along its cross-section. Unlike the present disclosure, the disclosure of the EP 0 625 414 A1 patent is a non-monoblock crosstie with limitations when it comes to the efficient transfer of loads from the steel structure to the concrete. It is also the product of a complex process that requires more time to manufacture.

The EP 0 361 227 B1 patent discloses a monoblock pre-stressed concrete crosstie that has at least two tensile steel elements that can be bars, wires or cables extending diagonally and/or radially in straight lines towards the crosstie ends, in which they have any type of anchors. For manufacturing, this arrangement of wires becomes a complicated network that aims to position the center of gravity of the concrete and steel within an appropriate distance to maintain the internal forces of the element within regulatory limits. The disclosure of the EP 0 361 227 B1 patent does not optimize the volume of material required, due to the fact that the adhesion of steel requires a specific transfer length, and hence is longer, and is also more complex than the disclosure of the EP 0 625 414 A1 patent, and is more costly to manufacture.

In regards to steel reinforcements looking for maximum adhesion to the concrete at the ends to reduce the transfer length, the EP 0 687 772 patent relates to a high yield stress steel helix that is placed around the ends of the reinforcing elements to reinforce and transfer the pre-stressing force of the steel structure to hardened concrete. U.S. Pat. No. 4,098,460 discloses at least one coiled cable limited to either side of the elements of the pre-stressed steel (which in the patent are called tendons), or two interlaced elements (as if they were screwed to one another) that form a helicoidal arrangement. Optionally, it is open to the possibility of including additional reinforcement in the form of rectangular rods placed towards the base of the crosstie underneath the area where the rail seat is located. Both systems, which are based on spirals for reinforcing the concrete and to increase the concrete-steel adhesion, fail to efficiently reduce the required transfer length, and on the other hand, their production processes requires a complex and accurate manufacturing (hence being more expensive) to meet required concentricity between the spirals and pre-stressed steel, in contrast to the present disclosure.

The EP 0 293 781 B1 patent discloses a one-piece anchor to hold the pre-stressed steel that is made of hot pressed standard steel with rounded sides that, when compared to the middle part, are wider. These wider ends make room for the holes that the anchor requires to hold the tension bolt and pre-stressed cables. The irregular geometry has a complex design that is the result of the type of material used. In addition, the manufacturing process is expensive, and due to its large size, the thickness and size of the element is increased because the material used has limited tensile strength and is required to hold the pre-stressed steel.

U.S. Pat. No. 5,104,039 discloses that to maximize the interlocking of the crosstie with the ballast, and reduce the movement induced by the continued crossing of trains and weather conditions, an element where the side surfaces are designed with a sequence of trapezoidal wedges in a "male-female" pattern results. The bottom surface may be flat or textured and the top is almost parallel to the bottom surface. The crosstie requires additional concrete that makes up the outgoing part of the wedges, which has no structural justification.

FIG. 1 is an isometric view of monoblock, high-yield pre-stressed concrete crosstie with a structural geometry for ballasted railways on which high performance rail fastening systems are installed, in accordance with an exemplary embodiment of the present disclosure. Crosstie 100 can be fabricated using the materials and processes disclosed herein.

Crosstie 100 includes ends 1, which are faceted to optimize the use of material, facilitate de-molding and promote the lateral interlocking of crosstie with the ballast. The metal structure is completely contained within the element, and once the manufacturing process is complete, the tension bolts are removed and the lateral orifices resulting from the removal of the bolts may or may not be sealed with low shrinkage concrete, as shown in the detail (2). This design protects the steel from corrosion and oxidation. On the sides of the upper surface, rail seats 3 are designed with 1/40 inclination and have embedded fixation elements that allow the reception of various types of rail fastening systems. Rail seats 3 widen to provide a larger bearing area that is more robust and allows the rails to distribute the loads more efficiently with lower contact stresses. Crosstie 100 has a reduced length from the rail seats to ends 4 because the transfer length to achieve the necessary steel-concrete adhesion is not required by the steel structure, nevertheless the crosstie is still able to withstand the service loads. Along the body and on sides 5 of the crosstie, a geometric configuration that optimizes material use exists. Additionally, along the lateral surfaces of the crosstie, central wedges 6 and end wedges 7 are incorporated into the design in order to ensure interlocking with the ballast. The central part 8 of crosstie 100 has a compact uniform body according to the structural design requirements and a reduction in material consumption.

Figure 2:
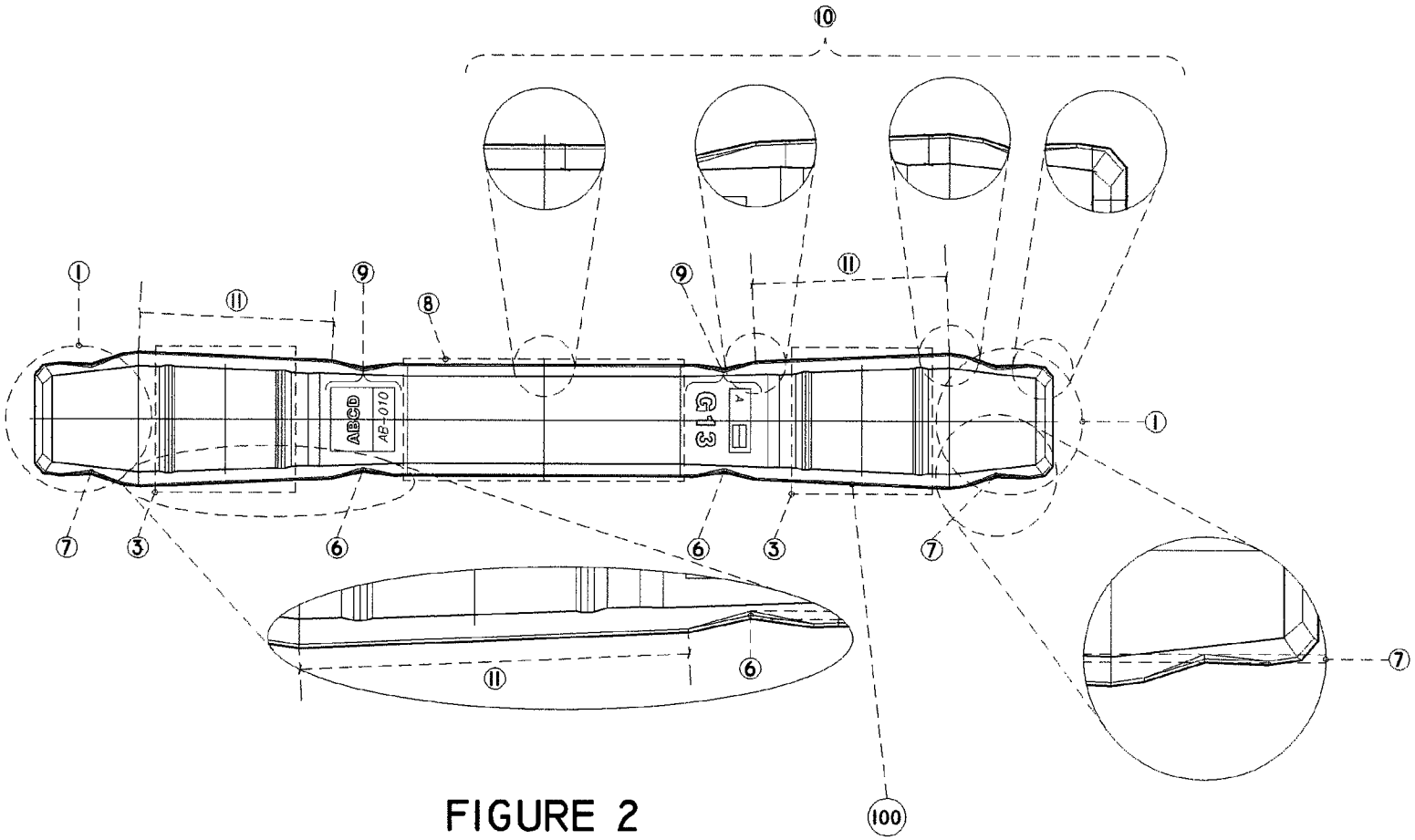
FIG. 2 shows a top view of a crosstie and different widths and shapes throughout its length that can be used to optimize its size and maximize its performance, in accordance with an exemplary embodiment of the present disclosure.

FIG. 2 shows a top view of crosstie 100 and different widths and shapes throughout its length that can be used to optimize its size and maximize its performance, in accordance with an exemplary embodiment of the present disclosure. Faceted ends 1 exhibit a width similar to the central body by reducing the consumption of material in the ends of the element. Rail seats 3 widen in a trapezoidal manner responding to the design load requirements in the critical regions of the crosstie while the steel structure maintains its uniform design. Crosstie 100 has an embossed nomenclature 9 including: customer name, mold and sub-mold used, the crosstie model, the rail fastening system to be used and the date of manufacture. Throughout crosstie 100, its configuration changes in width, being wider at the bottom compared to upper surface 10, thus facilitating the removal from the mold and contributing to the interlocking of the crosstie with the ballast. At its central part, the width is uniform. If the difference in width, measured in floor plan view from the base of the crosstie in relationship to upper surface 10, is taken as a reference, it may be said that central wedges 6 are formed in its upper point approximately ⅓ the distance from upper surface 10 of crosstie 100 relative to the base, and end in the bottom about ⅔ the distance from the upper surface.

End wedges 7 begin at their highest point at ½ the distance from the upper surface of the crosstie faceted end, and at the lower part it aligns to the side of the crosstie base width.

The configuration of the width of central wedges 6 involve a protruding notch located towards the crosstie center of about 1 3/16 inches in length that becomes the starting point of the wedges, the wedges that follow are approximately 5 15/16 inches wide at their base and are also central elements for ballast interlocking and then become longitudinal inclinations in the rail seat area. End wedges 7 are made up of two chamfers that measure approximately 1 9/16 inches long located at the end sides of the rail seats. These chamfers provide a transition to the end wedges that are approximately 5 15/16 inches wide at their base and are also central elements for ballast interlocking at the crosstie ends. Chamfered areas eliminate sharp angles to prevent concrete chipping. The longitudinal inclinations opposed to each other towards center of crosstie 100 beneath the rail seat, prevent the longitudinal displacement of the crosstie when in service. The longitudinal inclination is at least 2° towards the ends. Widened rail seat 3 provides ample base support to bear the loads efficiently.

Figure 3:
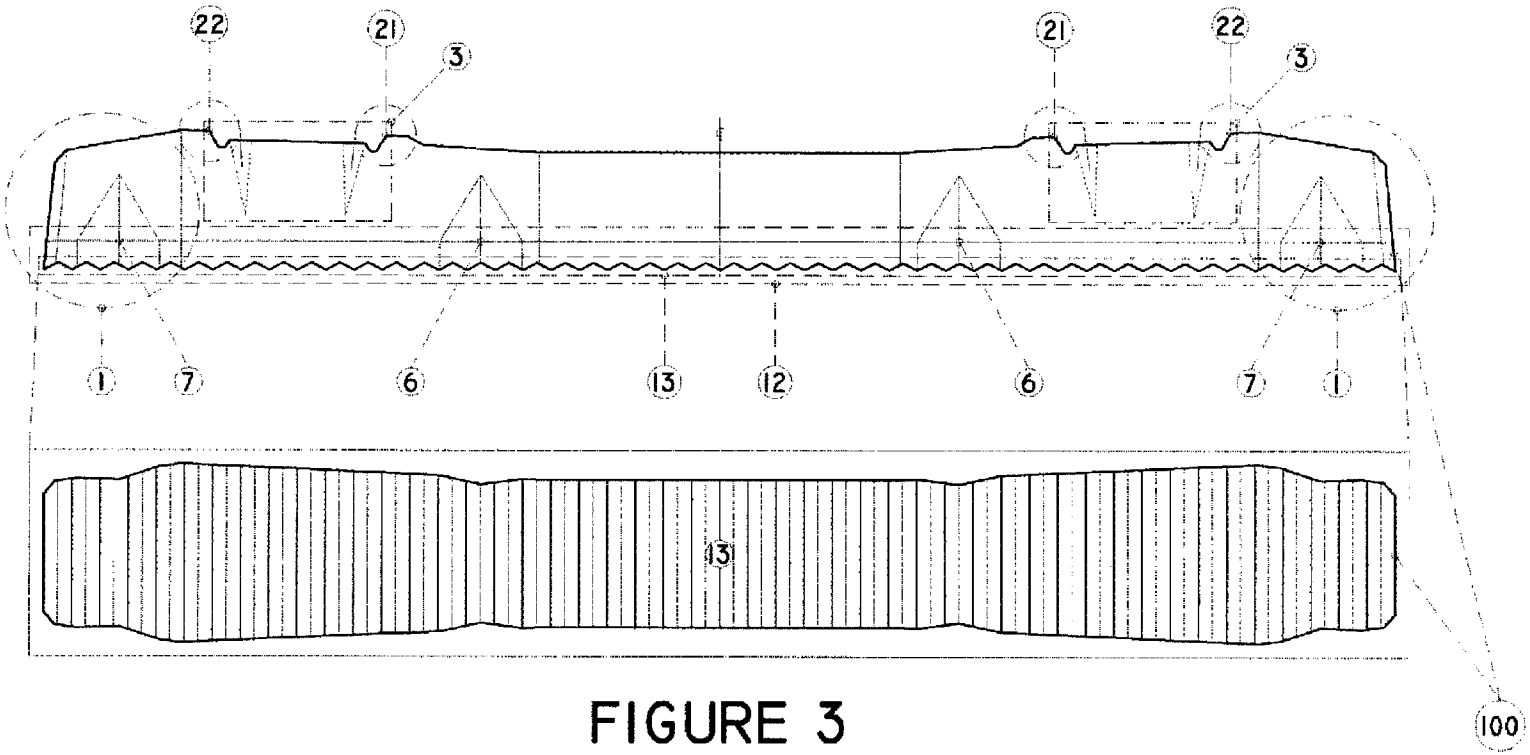
FIG. 3 shows a side view of a crosstie where height variations, configurations and inclinations in the upper surface are described, in accordance with an exemplary embodiment of the present disclosure.

FIG. 3 shows a side view of crosstie 100 where the height variations, configurations and inclinations in the upper surface are described, in accordance with an exemplary embodiment of the present disclosure. Furthermore, the geometry that promotes interlocking in the ballast and that reduces internal forces within the element and improves its performance can be observed. It also shows the base of the crosstie, optionally, can have wedges in various configurations of patterns to enhance the interlocking of the crosstie to the ballast.

Faceted ends 1 show an upper inclination that gradually reduces its height from the center towards the outermost part of the end and the lateral surfaces are inclined towards the center of the crosstie's longitudinal axis. These, apart from allowing easy de-molding, increase the area of the base support and stabilizes the crosstie once installed in its service position. Central wedges 6 and end wedges 7 are wider at the base and its height is between ¾ and ⅘ the total height of the crosstie, the wedges are located at the side of the rail seats and favor the interlocking with the ballast to meet the technical specifications and prevent lateral, longitudinal and/or rotational displacement. Rail seats 3 can be modified to meet the requirements of any suitable rail fastening system that delivers the performance and reliability required. These fastening systems can be either external licensed technologies or developed within the company and by own initiative. Rail seats 3 have robust gauge 21 and field shoulders 22 that provide a large support area to take lateral loads effectively. At its sides, the crosstie's lower perimeter has an angular inclination that forms a smooth base 12, which minimizes sharp corners on the edges to facilitate mold release, reduce chips in the concrete and optimize the volume of material used. Finally, the base surface shown as a bottom view plant 13 can have a pattern of wedges which measure at least ¼ of an inch wide and ¼ of an inch deep. These can be arranged in various ways and serve to promote the stability of the element in its support area avoiding any displacements.

Figure 4:
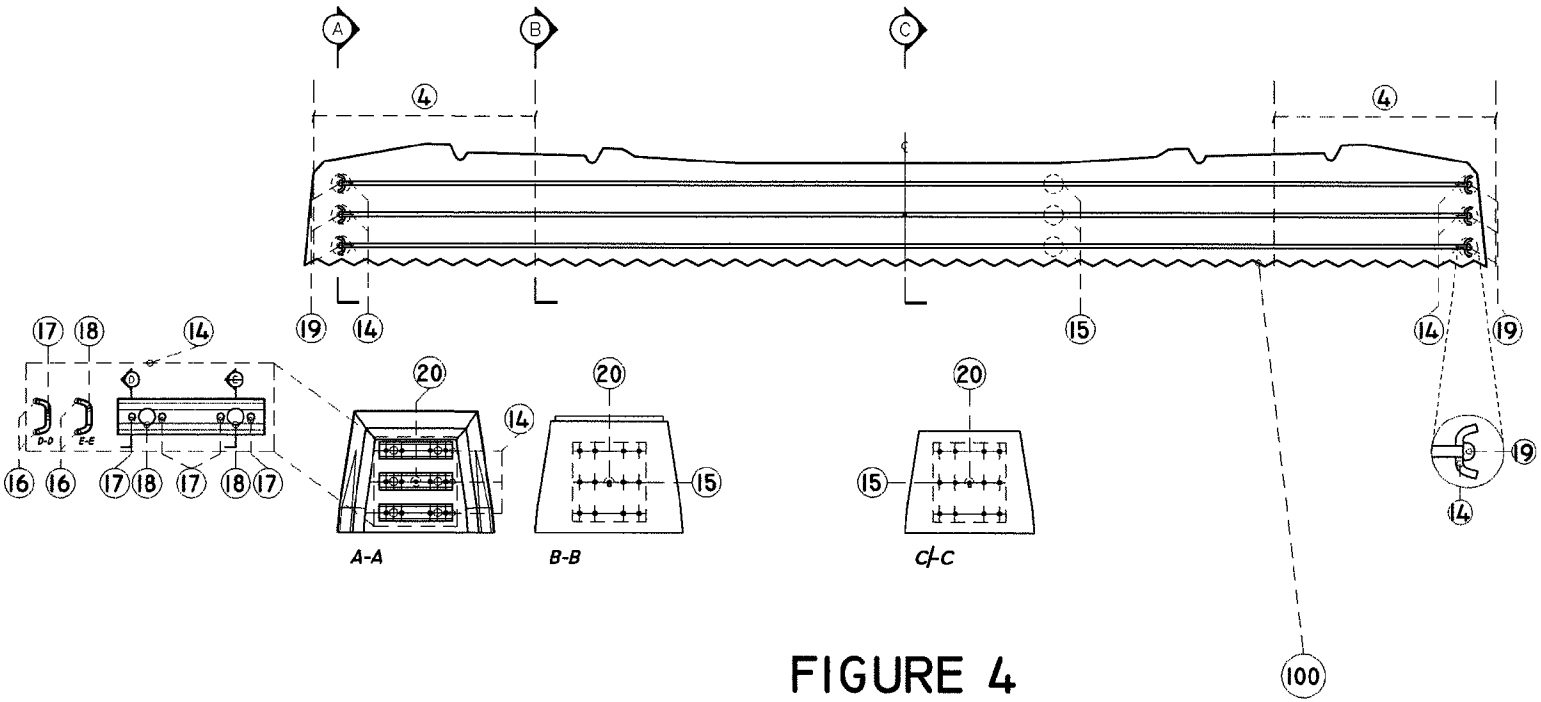
FIG. 4 is a diagram of three longitudinal sections that show the arrangement of the steel structure and the clamping plates at the end of the crosstie, in accordance with an exemplary embodiment of the present disclosure.

FIG. 4 is a diagram of three longitudinal sections that show the arrangement of the steel structure and the clamping plates at the end of crosstie 100, in accordance with an exemplary embodiment of the present disclosure. Section A-A shows the metallic structure where the fixing plates of the metal structure are located. Section B-B shows the center of the rail seat where the rail is located and transmits the forces of the passing trains to the crosstie. Section C-C shows the disposition of the steel structure within the crosstie at the center point, which is the most slender section of the element.

The layout and characteristics of the steel structure and the concrete crosstie allow lengths 4 from the center of the rail seat to the crosstie's end to be reduced to a longitude of 18 inches or less, giving a total crosstie length of 8 feet or shorter. Pre-stressed clamping anchor plates 14 are made of high strength steel and are placed at the ends of crosstie 100 to allow pre-stressed steel 15 to acquire the required compression in the concrete without requiring a transfer length. The pre-stressed clamping plates are made of ultra-high strength steel having preferred dimensions of 6 inches long and 1½ inches high (dimensions may vary ±¼ of an inch), with a bend 16 at the top and bottom areas at an angle close to 14°. These plates have four round holes 17 of at least ¼ inches in diameter and two piercings 18, which allow the passage of tensioning bolts of a minimum diameter of 11/16 inches. The pre-stressed wires are formed of cold rolled steel with a diameter of ¼ inches (range of variability ±3/32 inches) and the group is composed of at least eight wires. These wires are arranged longitudinally and if seen from a cross section they are placed on a grid of three vertical levels and has at least two wires per level. The pre-stressed steel is tensioned to at least 70% (seventy percent) of its capacity. To achieve the tie-up of the wire to the anchor plate, button head knots 19, which hold themselves to the circular perforations of the plate, are used. The function of the button head is to secure and support the forces exerted by the pre-stressed wires on the anchor plate. Button head knots 19 of the pre-stressed wires have a diameter of at least 40% (forty percent) wider than the wire itself. The two holes for the locking of the tensing bolts allow the clamping of the anchor plate to exert a tensile force to the wires pre-stressing them during the manufacturing process, this force is maintained until the concrete has cured and afterwards, the bolts are removed. The steel structure has its center of gravity located, with respect to the center of gravity 20 of the concrete, in a suitable position so the internal bending forces are within the appropriate specified limits in order to achieve the efficiency of the two materials.

The disclosure thus provides 1) a steel structure composed of anchoring plates at the crosstie's ends and pre-stressed wires that run longitudinally from one end to the other, 2) the use of high performance steel and concrete and their design that form a monoblock crosstie element reduced in length that can tolerate heavy loads, and 3) a faceted geometry that promotes crosstie-ballast interlocking and the elements stability. The steel structure includes a set of cold drawn steel pre-stressed wires organized in a reticular grid. The wires extend longitudinally along the crosstie and are fastened to each end of the crosstie with a number of anchoring plates made of high yield-strength steel of a minimum tensile strength of 110 kilo pounds per square inch (ksi) derived from the cold forming of hot rolled steel strips. The ends of the wires are topped with button head type knots to provide adequate interlock with the anchor plates.

The plates and the wires work together. The plates compress the concrete from end to end and the wires adhere to the concrete all along their length, the structure transfers all loads to the concrete along its entire length, which in turn allows the design of a shorter monoblock crosstie. The interaction of the steel structure and the high strength concrete allows the crosstie to function integrally improving its performance and lifespan.

The overall dimensions of the crosstie are reduced in length. The design load on each axle is 39 tons (US) or more and crosstie is 8 feet long or less. The distance from the center of the rail seat to the nearest end is 18 inches or less. This is an engineering achievement due to the synergy of the steel structure and the high strength concrete that have been previously described due to the fact that concrete crossties that bear similar loads are, on average, 8 feet 6 inches long. This stands for a reduction of 6% in length comparatively.

The geometry of crosstie 100 can meet the specifications required to fulfil its functions and meet the load and strength requirements. The geometric outline is irregular and it is designed according to the different needs of the crosstie, but its form remains aesthetically attractive and has a unique identity. The geometry also provides increased stability and interlocking with the ballast. The lateral wedges of which the crosstie is provided allow the ballast to find a place in these slots to prevent movement. The trapezoidal shapes of the rail seats oppose each other and also play a role in unifying the ballast-crosstie system due to the fact that they limit the movement of the ballast and partially confine it to the center of the sides of the concrete crosstie. This configuration causes the ballast to remain in place and in turn the latter favors the crosstie by holding it in position. In the crosstie ends, a multifaceted form with additional wedges has been provided. The end designs allows the allocation of the ballast gravel in positions that maximize its efficiency to stabilize the element.

Crosstie 100 has a wider base area beneath the rail seats to maximize the area of the footprint at the point where larger loads are common. The widening of the rail seat provides a structurally robust area 12 inches wide at its center, being the widest crosstie at its rail seat that allows the installation and maintenance of the track with existing conventional machinery. Furthermore, the rail seat design has broader field shoulders that take the lateral loads. These shoulders have larger bearing areas than those in conventional crossties hence the contact pressure is distributed among a bigger area increasing the life span of the tie and the fastening system.

The geometry of crosstie 100 is intrinsically related to the steel structure for its reduced length is the result of the pre-stressed steel design and its larger cross section allows for more pre-stressed wires to be introduced. Chamfers and fillets are added to crosstie 100, which, together with the general geometry, reduce the amount of angles that are greater than ninety degrees, to diminish chipping and cracks in the concrete. The element results in a robust monoblock concrete crosstie that works efficiently to allow the safe transit of trains.

By bringing together innovative features into the crossties design as its pre-stressed steel structure, high strength concrete and geometry, it can be said that the efficiency achieved in respect to its functionality and performance is unprecedented in the rail industry.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed is:

1. A monoblock pre-stressed concrete crosstie for use in ballasted railways comprising:

an elongated concrete element having a longitudinal axis;

an internal steel structure of the concrete element comprising one or more reinforced steel plates, each having a first tensioning structure configured for connection to an external tensioning device and a second tensioning structure coupled to a steel element that is internal to the monoblock pre-stressed concrete crosstie;

one or more widened rail seat and shoulder bearing surface of the concrete element; and symmetric opposing sides of the concrete element, each having a plurality of lateral wedges configured to interlock with railroad ballast;

wherein the reinforced steel plates comprise a system of reinforced, c-shaped plates and pre-stressed wires embedded in high strength concrete capable of supporting a minimum axle load of 39 tons (US), and where the crosstie has a maximum length of 8 feet.

2. The crosstie of claim 1 wherein the reinforced steel plates comprise two or more first c-shaped plates at a first end and two or more second plates at a second end, each of the first c-shaped plates coupled to one of the second plates by a plurality of pre-stressed wires, wherein each wire is tensioned to at least 70% (seventy percent) of its elastic capacity, wherein the plurality of pre-stressed wires are arranged in parallel, and wherein each of the plurality of pre-stressed wires is secured to one or more of the plates by pressed button head knots located at the wire ends.

3. The crosstie of claim 1, wherein the reinforced steel plates comprise two or more reinforced plates at each end, wherein the reinforced plates of the internal steel structure are embedded in the concrete and apply a compressive force to the concrete, and a plurality of pre-stressed wires that work by adherence to transfer a load to the concrete.

4. The crosstie of claim 1, wherein the elongated concrete element is shorter than 8 feet in length and is able to withstand large railway axle loads of at least 39 tons (US).

5. The crosstie of claim 1 wherein the elongated concrete element has dimensions from a center of a rail seat to a nearest end of 18 inches or less.

6. The crosstie of claim 1 further comprising a plurality of rail seats and a plurality of field-side shoulders having a transverse width of approximately 10 inches on an upper surface of the crosstie, where one or more the rail seats widens to approximately 12.3 inches at a base.

7. The crosstie of claim 1 wherein the elongated concrete element comprises a center section having a first width, wherein the rail seat and shoulder bearing surface has a second width, and wherein the ends have a third width, and wherein the second width is greater than either the first width or the third width.

8. The crosstie of claim 1 wherein the plurality of lateral wedges comprise two or more wedges in each end and two or more wedges at a transition between each of two widened rail seat and shoulder bearing surfaces and a central body.

9. The crosstie of claim 1 wherein a center of gravity of the elongated concrete element and a center of gravity of the internal steel structure are selected based on a service load.

10. The crosstie of claim 1 wherein the reinforced steel plates comprise two or more first plates at a first end and two or more second plates at a second end.

11. The crosstie of claim 10 wherein each of the first plates coupled to one of the second plates by a plurality of pre-stressed wires.

12. The crosstie of claim 11 wherein each wire is tensioned to at least 70% (seventy percent) of its elastic capacity.

13. The crosstie of claim 12 wherein the plurality of pre-stressed wires are arranged in parallel.

14. The crosstie of claim 13 wherein each of the plurality of pre-stressed wires is secured to one or more of the plates.

15. The crosstie of claim 1, wherein the reinforced steel plates comprise two or more plates at each end that are configured to apply a compressive force to the concrete.

16. The crosstie of claim 1, wherein the internal steel structure comprises reinforced steel plates comprise a system of plates and pre-stressed wires embedded in high strength concrete.

17. The crosstie of claim 1 wherein a center of gravity of the elongated concrete element is aligned in relation to the center of gravity of the internal steel structure to effectively resist service loads.

18. The crosstie of claim 1 further comprising a plurality of wedges disposed along a bottom surface of the elongated concrete element.

19. A monoblock reinforced concrete crosstie for use in ballasted railways comprising:

an elongated concrete element having a longitudinal axis;

an internal steel structure of the concrete element comprising one or more c-shaped steel plates, each having a first tensioning structure configured for connection to an external tensioning device and a second tensioning structure coupled to a steel element that is internal to the monoblock pre-stressed concrete crosstie;

one or more widened rail seat and shoulder bearing surface of the concrete element; and symmetric opposing sides of the concrete element, each having a plurality of lateral wedges configured to interlock with railroad ballast, wherein the c-shaped steel plates comprise two or more first plates at a first end and two or more second plates at a second end, each of the first plates coupled to one of the second plates by a plurality of pre-stressed wires, wherein each wire is tensioned to at least 70% (seventy percent) of its elastic capacity, wherein the plurality of pre-stressed wires are arranged in parallel, and wherein each of the plurality of pre-stressed wires is secured to one or more of the plates by pressed button head knots located at the wire ends, wherein the plates of the internal steel structure are embedded in the elongated concrete element and apply a compressive force to the elongated concrete element, wherein the plurality of pre-stressed wires work by adherence to transfer a load to the concrete, wherein the elongated concrete member is made of high strength concrete capable of supporting a minimum load of 39 tons (US) on each axle of the crosstie, wherein the crosstie has a maximum length of 8 feet, wherein the elongated concrete element has dimensions from a center of a rail seat to a nearest end of 18 inches or less, a plurality of rail seats and a plurality of field-side shoulders having a transverse width of approximately 10 inches on an upper surface of the crosstie, where one or more the rail seats widens to approximately 12.3 inches at a base, wherein the elongated concrete element comprises a center section having a first width, wherein the rail seat and shoulder bearing surface has a second width, and wherein the ends have a third width, and wherein the second width is greater than either the first width or the third width, wherein the plurality of lateral wedges comprise two or more wedges in each end and two or more wedges at a transition between each of two widened rail seat and shoulder bearing surfaces and a central body, and further comprising a plurality of wedges disposed along a bottom surface of the elongated concrete element.

20. A monoblock pre-stressed concrete crosstie for use in ballasted railways comprising:

an elongated concrete element having a longitudinal axis;

an internal steel structure of the concrete element comprising one or more reinforced steel plates, each having a first tensioning structure configured for connection to an external tensioning device and a second tensioning structure coupled to a steel element that is internal to the monoblock pre-stressed concrete crosstie;

one or more widened rail seat and shoulder bearing surface of the concrete element; and symmetric opposing sides of the concrete element, each having a plurality of lateral wedges configured to interlock with railroad ballast;

wherein the reinforced steel plates comprise two or more first c-shaped plates at a first end and two or more second plates at a second end, each of the first c-shaped plates coupled to one of the second plates by a plurality of pre-stressed wires, wherein each wire is tensioned to at least 70% (seventy percent) of its elastic capacity, wherein the plurality of pre-stressed wires are arranged in parallel, and wherein each of the plurality of pre-stressed wires is secured to one or more of the plates by pressed button head knots located at the wire ends.

* * * * *